US006412669B1

(12) United States Patent
Chuang

(10) Patent No.: US 6,412,669 B1
(45) Date of Patent: Jul. 2, 2002

(54) LIQUID SUCKING AND DISPENSING DEVICE

(76) Inventor: Chia-Chiung Chuang, 3F,No. 22, Lane 337, Song-Jwu Road, Taichung City (TW)

( * ) Notice: Subject to any disclaimer, the term of this patent is extended or adjusted under 35 U.S.C. 154(b) by 0 days.

(21) Appl. No.: 09/882,039

(22) Filed: Jun. 18, 2001

(30) Foreign Application Priority Data

Dec. 20, 2000 (TW) ..... 089222099

(51) Int. Cl.[7] ..... B65B 3/00

(52) U.S. Cl. ..... 222/401; 222/400.8; 137/205; 137/209; 137/212; 141/59; 141/65; 141/67

(58) Field of Search ..... 222/401, 400.7, 222/400.8; 137/205, 209, 212; 141/59, 65, 67

(56) References Cited

U.S. PATENT DOCUMENTS 1,455,069 A * 5/1923 Bluemel ..... 137/212
2,458,999 A * 1/1949 Mills ..... 137/205
2,504,009 A * 4/1950 Phillips et al. ..... 222/400.7
2,536,492 A * 1/1951 Dunn et al. ..... 137/205
3,156,252 A * 11/1964 Johnston ..... 137/212
4,673,006 A * 6/1987 Speck ..... 141/65
5,265,653 A * 11/1993 Herlth ..... 141/65
5,427,505 A * 6/1995 Payne ..... 137/205
5,566,728 A * 10/1996 Lange ..... 141/67

* cited by examiner

*Primary Examiner*—J. Casimer Jacyna
(74) *Attorney, Agent, or Firm*—Troxell Law Office PLLC

(57) ABSTRACT

A liquid sucking and dispensing device includes a body having a passage and an air inlet and an air outlet are respectively located one two ends of the body. A first valve is engaged with the passage at a mediate section of the passage and a second valve is engaged with the passage at a second end of the body. An opening is defined radially through the body and communicates with the passage and an interior of a container. When the second valve closes the passage, pressurized air enters the container to push liquid in the container out from the container.

5 Claims, 8 Drawing Sheets

LIQUID SUCKING AND DISPENSING DEVICE

FIELD OF THE INVENTION

The present invention relates to a liquid sucking and dispensing device which is connected to a cover of a container and is able to suck liquid into the container and to dispense the liquid out from the container.

BACKGROUND OF THE INVENTION

A conventional sucking device for sucking liquid into a container generally includes a fitting connected to an air compressor so as to provide pressurized air into the sucking device. The sucking device includes an air outlet for releasing the pressurized air so as to generate a lower pressure area in the container to suck liquid into the container. It is easy to suck liquid into the container by using the pressure difference between the pressure in the interior of the container and the pressure of outside of the container. However, after the container is filled with the liquid, no suitable and convenient way to dispense the liquid out from the container because the conventional sucking device can only suck the liquid into the container.

The present invention intends to provide a liquid sucking and dispensing device that has dual features to suck and to dispense the liquid into and out from the container.

SUMMARY OF THE INVENTION

In accordance with one aspect of the present invention, there is provided a liquid sucking and dispensing device and comprises a body having a passage defined longitudinally therethrough. An air inlet is defined in a first end of the body and an air outlet is defined in a second end of the body. A first valve is engaged with the passage at a mediate section of the passage and a second valve is engaged with the passage at the second end of the body. An opening is defined radially through the body and communicates with the passage and is located between the first valve and the second valve.

The primary object of the present invention is to provide a device that has a valve that controls the device to suck liquid into a container or to expel liquid in the container.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
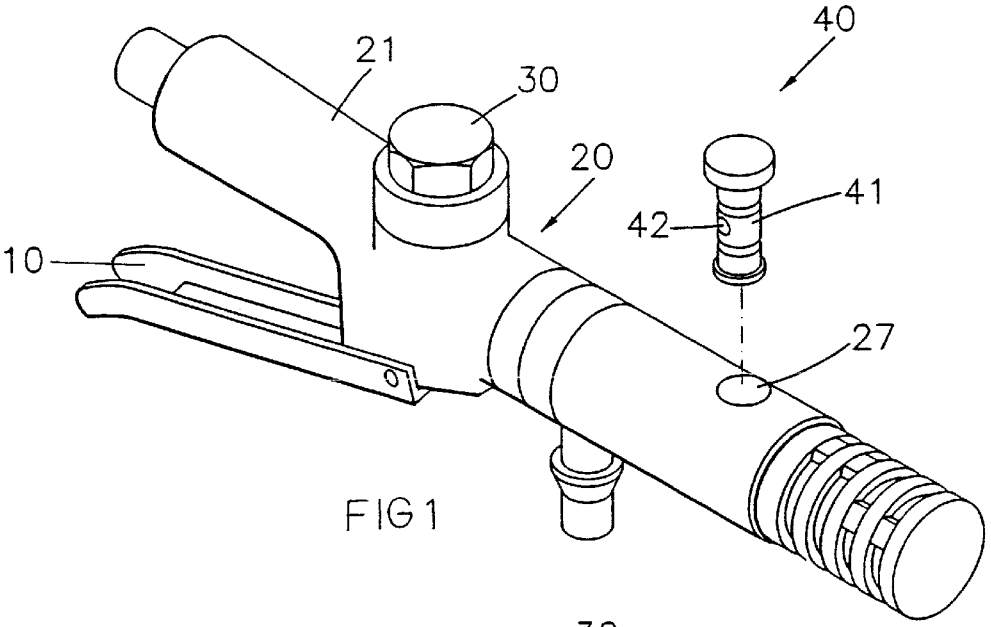
FIG. 1 is a perspective view to show a liquid sucking and dispensing device of the present invention.
Figure 2:
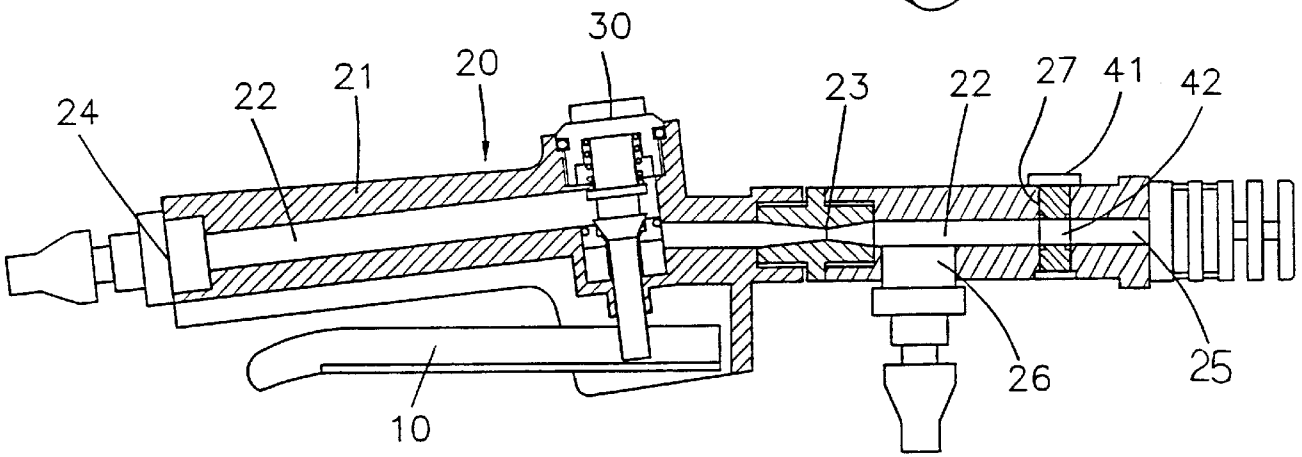
FIG. 2 is a cross sectional view to show the liquid sucking and dispensing device of the present invention.
Figure 4:
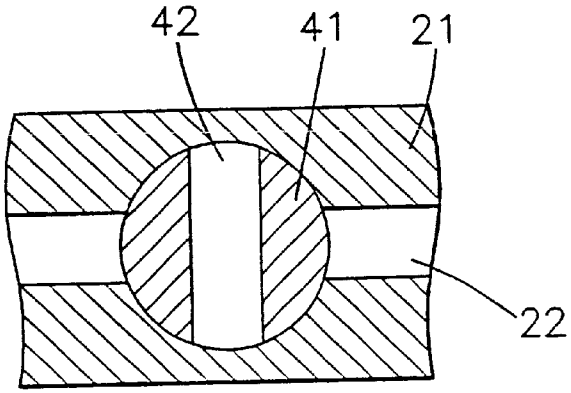
FIG. 4 is a cross sectional view to show the second valve is rotated to a close position in the passage.
Figure 3:
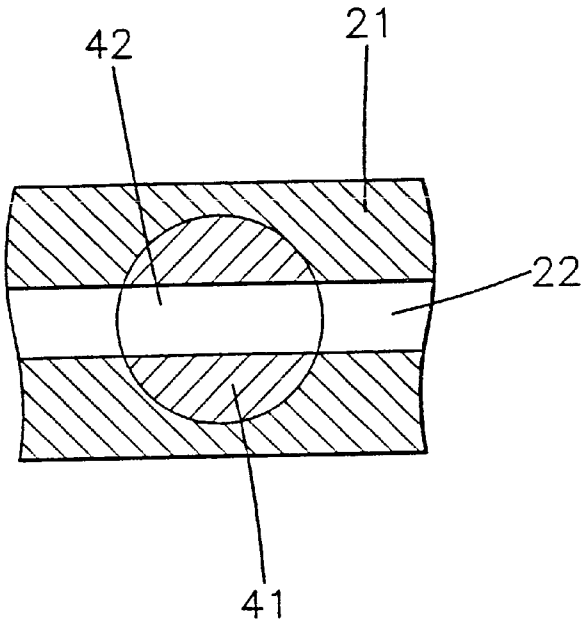
FIG. 3 is a cross sectional view to show the second valve is rotated to an open position in the passage.

Referring to FIGS. 1 and 2, the liquid sucking and dispensing device 20 of the present invention comprises a body 21 having a passage 22 defined longitudinally therethrough and an air inlet 24 is defined in a first end of the body 21 and an air outlet 25 is defined in a second end of the body 21. The passage 22 has a narrow section 23 so as to increase the pressure in the passage 22. A first valve 30 is transversely movably engaged with the passage 22 and cooperated with a spring so that the first valve 30 can be moved in the body 21. The first valve 30 is located between the air inlet 24 and the narrow section 23. A handle 10 is pivotally connected to the body 21 and the first valve 30 has a section extending radially from the body 21 so that the section of the first valve 30 can be pushed by the handle 10 to open the passage 22 as shown in FIG. 2. A second valve 40 is transversely rotatably engaged with a hole 27 in the body 21 and the passage 22 and located between the narrow section 23 and the air outlet 25. Further referring to FIGS. 3 and 4, the second valve 40 includes a cylindrical body 41 and a hole 42 is defined radially through the cylindrical body 41. The cylindrical body 41 is rotated to an open position as shown in FIG. 3 to communicate the hole 42 with the passage 22. An opening 26 is defined radially through the body 21 and communicates with the passage 22 and is located between the narrow section 23 and the second valve 40. A pipe can be connected to the opening 26 and is inserted in a container (not shown).

When the first valve 30 and the second valve 40 are both in open position, the pressurized air enters the passage 22 from the air inlet 24 and leaves from the air outlet 25. In the meanwhile, the air in the container will be sucked out from the container so that liquid outside of the container will be sucked into the container from other pipe (not shown).

Figure 5:
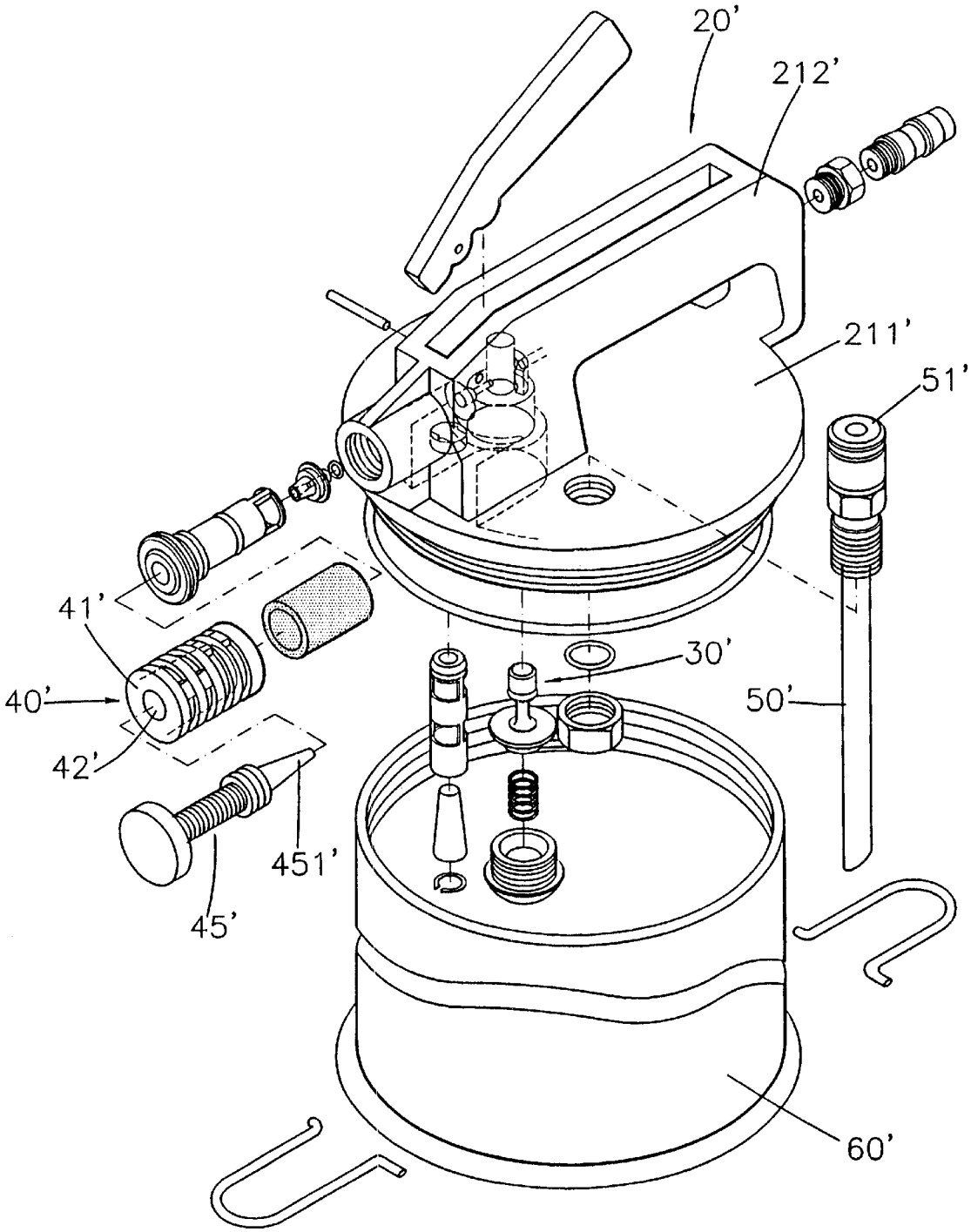
FIG. 5 is an exploded view to show another embodiment of the liquid sucking and dispensing device of the present invention.
Figure 6:
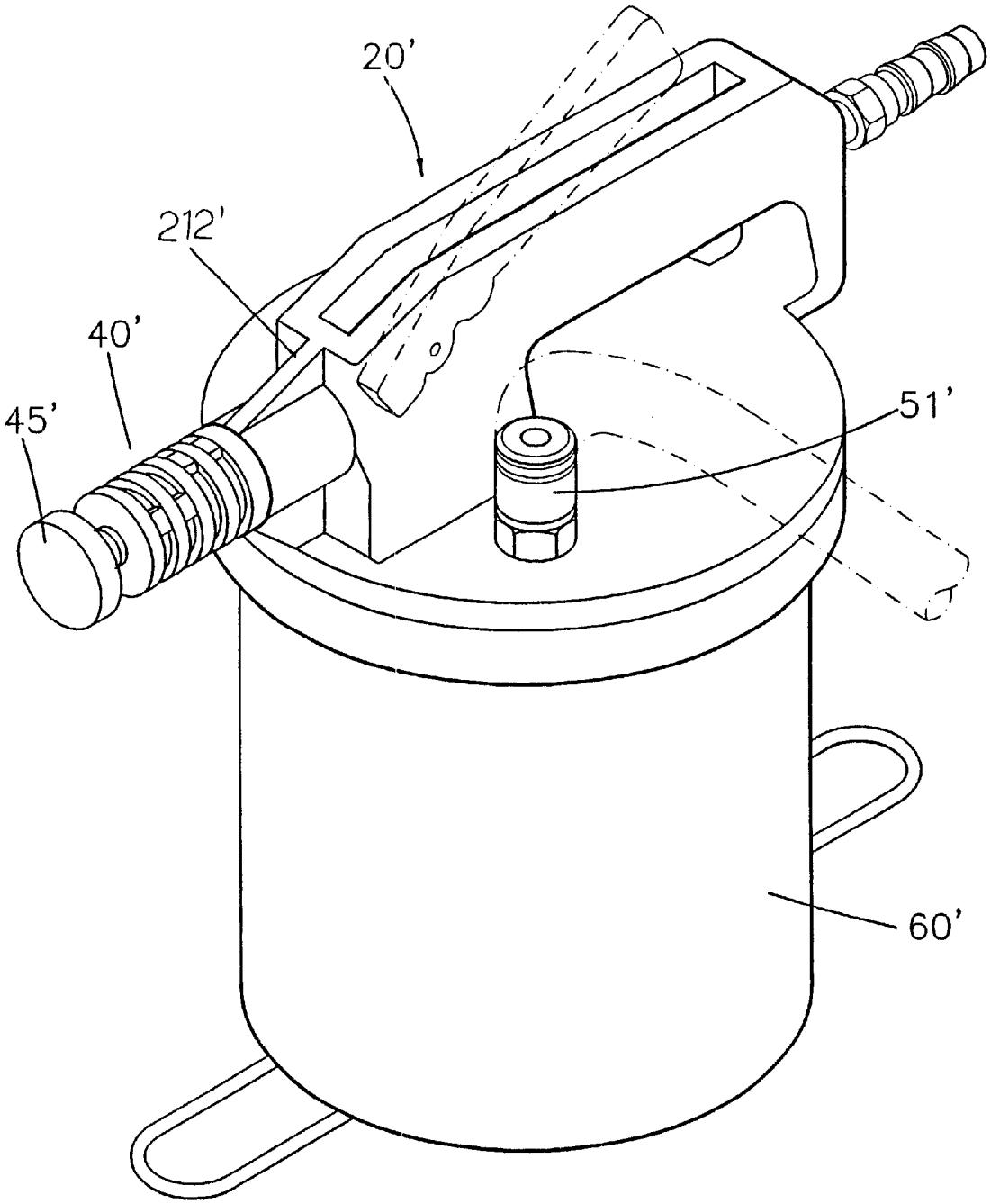
FIG. 6 is a perspective view to show the embodiment of the sucking and dispensing device as shown in FIG. 5 mounted to a container.
Figure 7:
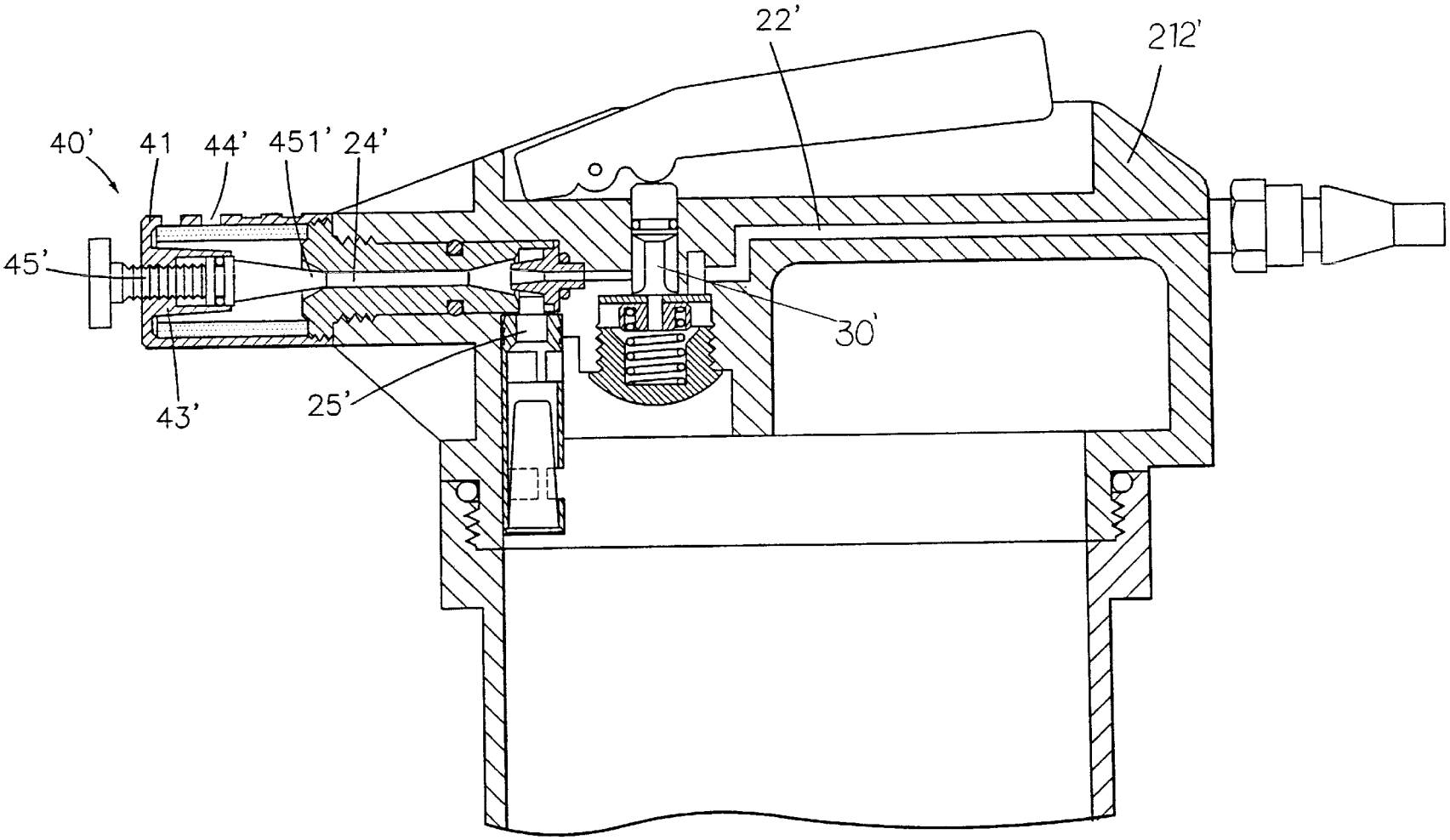
FIG. 7 is a cross sectional view to show the sucking and dispensing device as shown in FIG. 5 wherein the second valve is in a close position.
Figure 8:
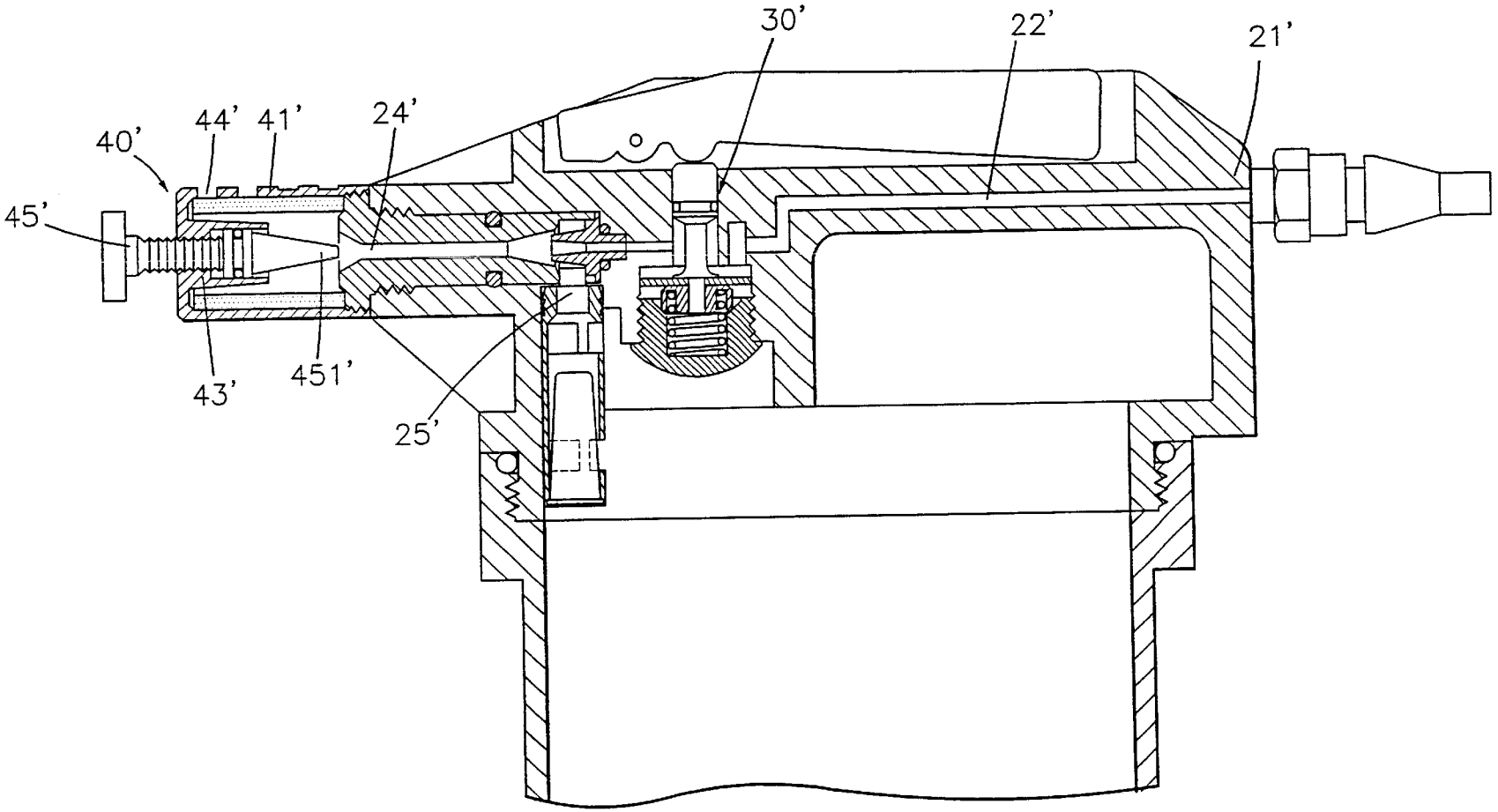
FIG. 8 is a cross sectional view to show the sucking and dispensing device as shown in FIG. 5 wherein the second valve is in an open position.

FIGS. 5 to 7 show another embodiment of the device 20' connected to a handle 212' on a cover 211' threadedly mounted to a container 60'. A fitting 51' and a pipe 50 extend through the cover 211' and insert into the container 60'. The first valve 30' is connected to the body 20' from an underside of the cover 211' and communicates with the passage 22'. The second valve 40' is linearly connected to the second end of the body in the handle 212'. A hole 25' is defined radially through the cover 211' and communicates with the passage 22' and the hole 25' communicates with an interior of the container 60'. The second valve 40' includes a sleeve 41' mounted to the second end of the body 21 and a movable member 45' movably received in an end hole 42' of the sleeve 41'. The sleeve 41' includes a plurality of slots 44' and a tubular portion 43' extends inward from an end of the sleeve 41' so that the movable member 45' extends through and is guided by the tubular portion 43'. The movable member 45' has a tapered tip 451' which movably seals the tapered shaped air outlet 24' of the passage 22'. As shown in FIG. 8 the movable member 45' is moved away from the cover 211' to open the outlet 24'. Pressurized air can release from the slots 44' in the sleeve 41'.

Figure 9:
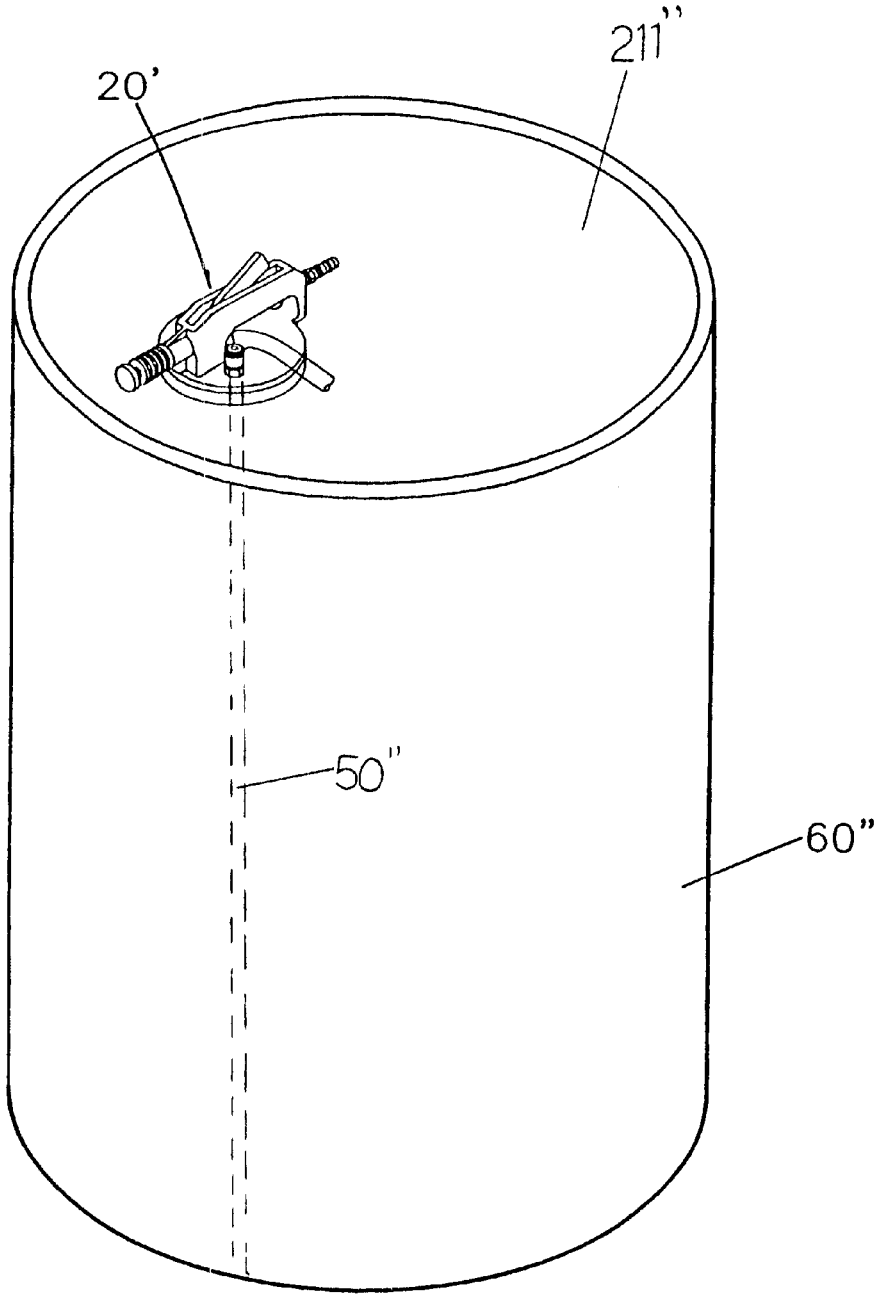
FIG. 9 shows that the sucking and dispensing device as shown in FIG. 5 is used with a large container.

FIG. 9 shows that the device 20' can be connected with a large container 60" wherein a long pipe 50" communicates with the cover 211" and a distal end of the long pipe 50" is an inclined end so that the liquid can be sucked out from the container 60" by the device 20'.

Figure 10:
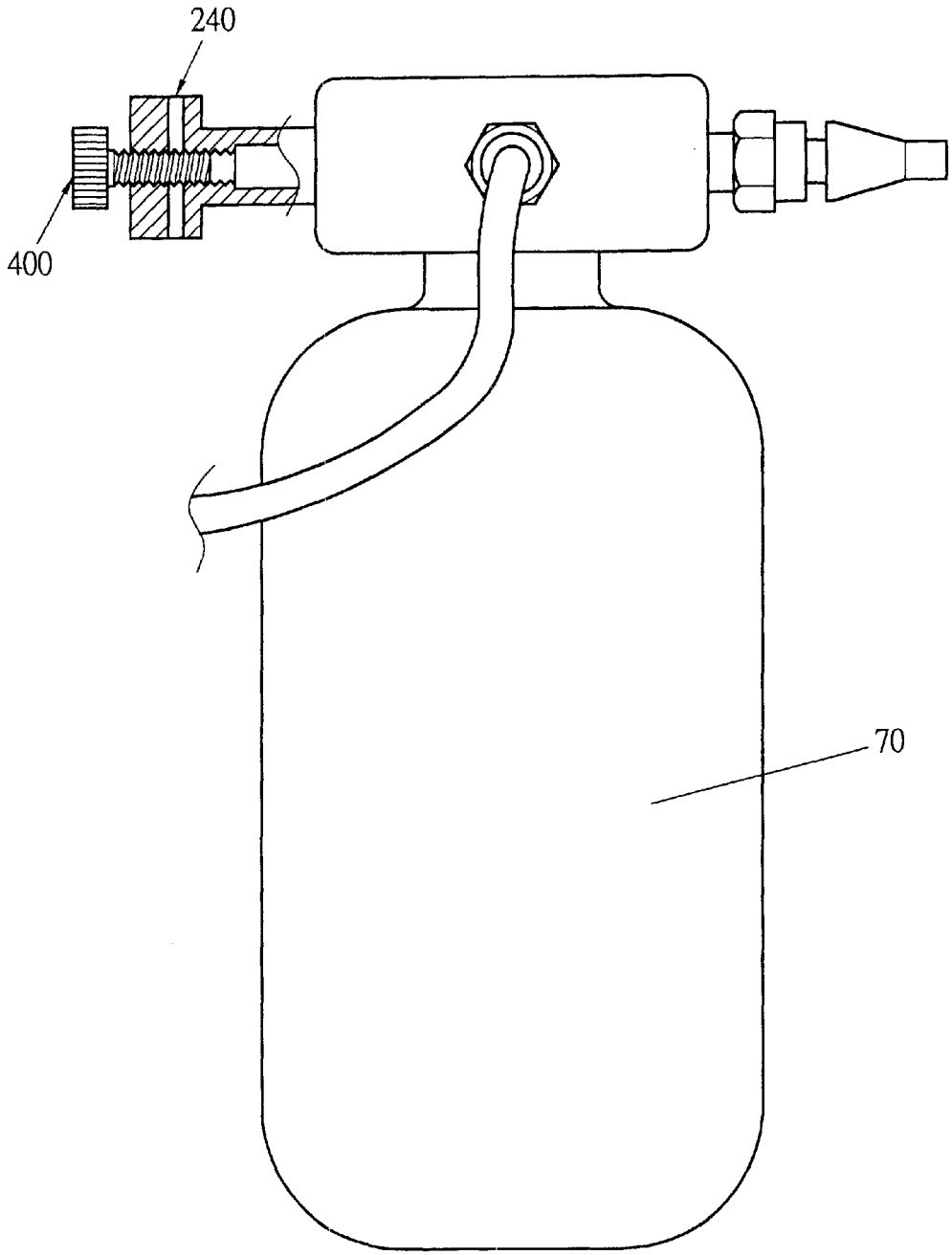
FIG. 10 shows that the sucking and dispensing device as shown in FIG. 5 is to used with a liquid gas tank.

FIG. 10 shows that a liquid gas tank 70 us cooperated with the device and the air outlet 240 is radially defined through the end of the body. The second valve 400 is threadedly connected to the body and movably seals the air outlet 240.

While we have shown and described various embodiments in accordance with the present invention, it should be clear to those skilled in the art that further embodiments may be made without departing from the scope and spirit of the present invention.

What is claimed is:

1. A liquid sucking and dispensing device comprising:

a) a body having a passage extending longitudinally therethrough, a first end of the passage forming an air inlet and a second end of the passage forming an air outlet, the body including a radial hole communicating with the passage;

b) a first valve mounted in the body between the air inlet and the radial hole, the first valve being movable between opened and closed positions in a direction transverse to the passage so as to open and close the passage;

c) a handle attached to the body so as to move the first valve between the opened and closed positions;

d) a sleeve attached to the body at the air outlet passage, the sleeve including an end wall, a side wall and a plurality of slots through the side wall; and, e) a second valve mounted on the sleeve and linearly movable in a same direction as the passage so as to open and close the air outlet.

2. The liquid sucking and dispensing device of claim 1 wherein the second valve includes a tapered tip which movably seals the air outlet.

3. The liquid sucking and dispensing device of claim 1 wherein the handle is pivotally attached to the body.

4. The liquid sucking and dispensing device of claim 1 wherein the body comprises a container cover.

5. The liquid sucking and dispensing device of claim 4 wherein the container cover includes a threaded portion for attachment to a container.

* * * * *